US006799634B2

(12) United States Patent
Hartog et al.

(10) Patent No.: US 6,799,634 B2
(45) Date of Patent: Oct. 5, 2004

(54) TRACER RELEASE METHOD FOR MONITORING FLUID FLOW IN A WELL

(75) Inventors: Floor Andre Hartog, Amsterdam (NL); Ulfert Cornelis Klomp, Amsterdam (NL); Jean Eric Negre, Verrieres le Buisson (FR); Douwe Johannes Runia, Rijswijk (NL); Yves Veran, Rijswijk (NL)

(73) Assignee: Shell Oil Company, Houston, TX (US)

( * ) Notice: Subject to any disclaimer, the term of this patent is extended or adjusted under 35 U.S.C. 154(b) by 153 days.

(21) Appl. No.: 10/296,880

(22) PCT Filed: May 31, 2001

(86) PCT No.: PCT/EP01/06270

§ 371 (c)(1),
(2), (4) Date: Nov. 27, 2002

(87) PCT Pub. No.: WO01/92685

PCT Pub. Date: Dec. 6, 2001

(65) Prior Publication Data

US 2003/0131991 A1 Jul. 17, 2003

(30) Foreign Application Priority Data

May 31, 2000 (EP) ..... 00401538

(51) Int. Cl.[7] ..... E21B 47/00; E21B 47/10

(52) U.S. Cl. ..... 166/250.12; 166/250.01; 73/152.29; 73/152.31

(58) Field of Search ..... 166/64, 66, 250.01, 166/250.12, 252.6; 73/152.29, 152.31, 152.33, 861.05; 175/42, 48

(56) References Cited

U.S. PATENT DOCUMENTS

| | | | | |
|---|---|---|---|---|
| 4,166,216 | A | 8/1979 | Cubberly, Jr. | |
| 4,846,279 | A | 7/1989 | Bruce | |
| 5,544,705 | A | 8/1996 | Jones et al. | |
| 5,718,287 | A | 2/1998 | Streich et al. | |
| 5,929,437 | A | 7/1999 | Elliott et al. | |
| 6,422,312 | B1 * | 7/2002 | Delatorre et al. | 166/250.15 |
| 2003/0056952 | A1 * | 3/2003 | Stegemeier et al. | 166/250.12 |

FOREIGN PATENT DOCUMENTS

| | | | |
|---|---|---|---|
| EP | 0 816 631 A2 | 1/1998 | E21B/47/00 |

* cited by examiner

*Primary Examiner*—David Bagnell
*Assistant Examiner*—Brian Halford

(57) ABSTRACT

A tracer release method for monitoring fluid flow in a well utilizes a deformable container having a liquid tracer material which container has an outlet which debouches into the neck portion of a venturi in a well conduit. The container has a wall which is at least partly exposed to the fluid pressure at the relatively wide in- or outlet of the venturi, so that an amount of tracer is injected continuously or discontinuously into the well effluents which is proportional to the pressure difference p across the venturi, which pressure difference p is indicative of the fluid density ρ and squared fluid velocity υ.

12 Claims, 2 Drawing Sheets

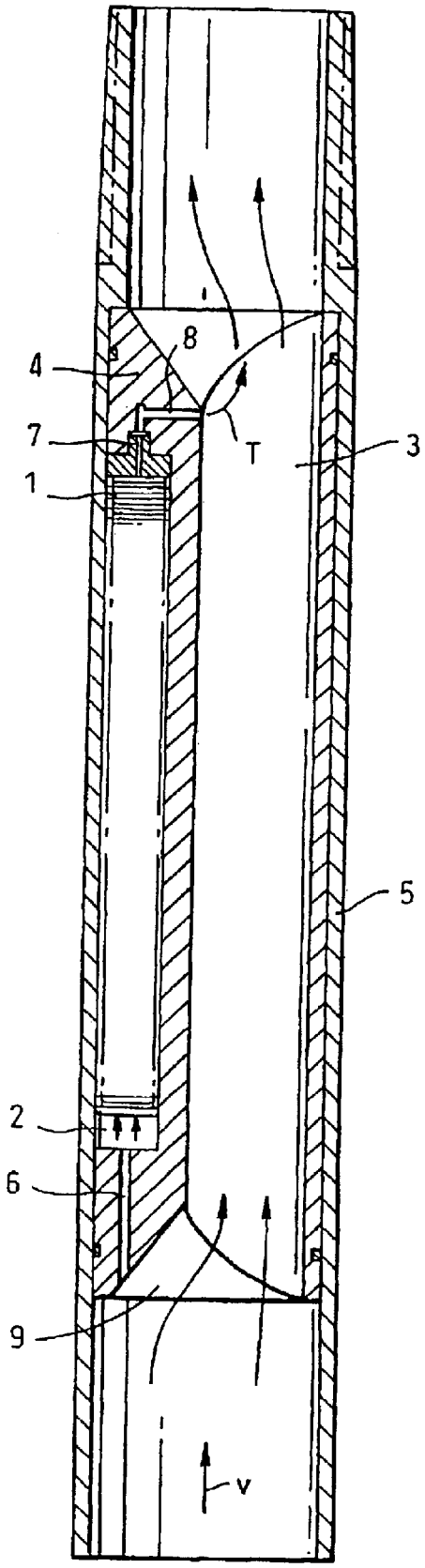
Fig.1.
Fig.2.
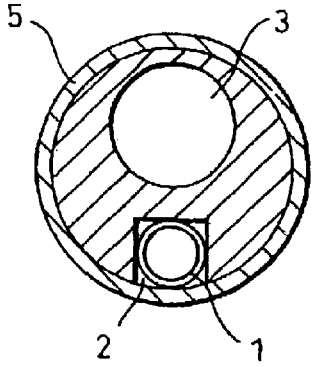

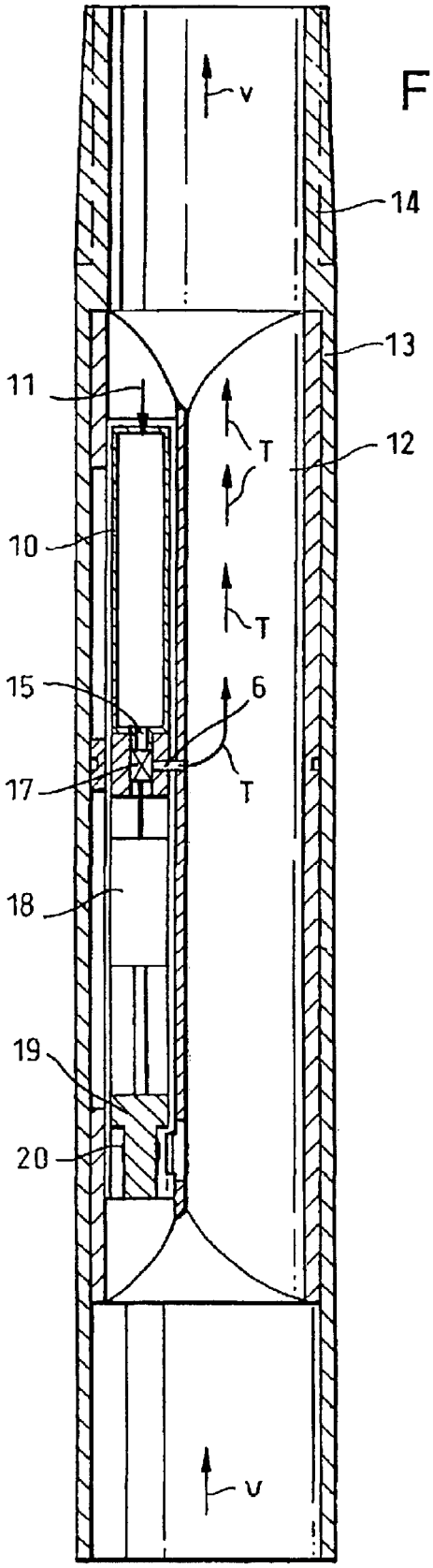
Fig.3.
Fig.4.
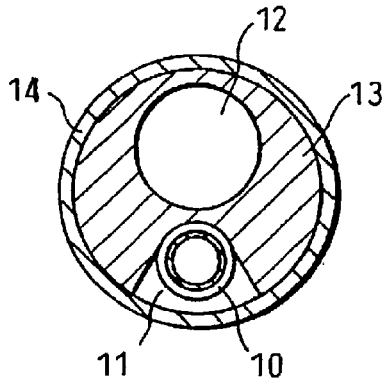

TRACER RELEASE METHOD FOR MONITORING FLUID FLOW IN A WELL

BACKGROUND OF THE INVENTION

The invention relates to a tracer release method for monitoring the fluid flowrate in a downhole well conduit. Such a method is known from European patent application No. 0816631.

In the known tracer release method different types of tracers are embedded in claddings along the length of the well inflow zone. The claddings may be oil soluble substances which slowly dissolve in the well fluids and the amount of tracer released is then an indication of the amount oil and/or gas into the well at a particular place.

Drawbacks of the known method are that significant quantities of tracer and cladding are required to monitor the flow of well effluents, that significant workover operations are required to replace the cladded wall tubulars after depletion of tracer material and that the amount of tracer released is not an accurate reflection of the amount of fluid flowing through the well, but is also dependent on the temperature and composition of the well effluents.

It is observed that U.S. Pat. No. 4,846,279 discloses a method for injecting a treatment fluid into a lower end of a well by means of a bag which is compressed by a pressure difference between a downstream and an upstream location of the well and that U.S. Pat. No. 5,544,785 discloses a method for downhole injecting a hardening agent into a cement slurry using a container from which the agent is injected into the slurry by means of a venturi effect.

U.S. Pat. No. 4,166,216 discloses a method for injecting various oil and/or water mixible tracer materials into a production tubing by means of a injection tool that is temporarily suspended in the well from a wireline.

SUMMARY OF THE INVENTION

It is an object of the present invention to alleviate the drawbacks of the known tracer injection method and to provide a tracer release method that provides a more accurate reflection of the fluid flowrate, which can be more easily replaced, which is able to release an accurately dosed minimal amount of tracer material into the well effluents and which is able to transmit other well data than the fluid flowrate to a well fluid flow monitoring and survey system at the earth surface.

BRIEF DESCRIPTION OF THE DRAWINGS

FIG. 1 is a longitudinal sectional view of a first embodiment of the tracer release system according to the invention;

FIG. 2 is a cross-sectional view of the system of FIG. 1;

FIG. 3 is a longitudinal sectional view of a second embodiment of the tracer release system according to the invention; and FIG. 4 is a cross-sectional view of the system of FIG. 3.

DETAILED DESCRIPTION OF THE INVENTION

The tracer release method according to the present invention utilizes a deformable container comprising tracer material and a venturi formed in the well conduit which is in fluid communication with said container such that in use an amount of tracer material is released through an outlet of the container into the conduit which is related to the static pressure difference between a neck portion of the venturi and a wider portion of the conduit. The amount of tracer thus released per unit of time into the venturi is measured downstream of the venturi, such as near the wellhead, and the measured quantity is indicative of the fluid velocity and/or density in the region of the venturi.

Preferably, at least part of the wall of the deformable container is exposed to the static pressure within said wider portion of the conduit and the outlet of the container debouches into the neck portion of the venturi.

Since the static pressure difference between the neck portion and said wider portion, e.g. at the entrance of the venturi, is proportional to $\frac{1}{2}\rho.\upsilon^2$, in accordance with Bernouilli's law, where $\rho$ is the fluid density and $\upsilon$ is the fluid velocity, the amount of tracer released is in that case proportional to the fluid density and the squared fluid velocity.

Alternatively, the deformable container is compressed by a spring and the wall is exposed to the relatively low static fluid pressure at the neck portion and the tracer outlet debouches into a wider portion of the conduit e.g. downstream of the venturi, so that the amount of tracer released decreases when the fluid density $\rho$ and/or velocity $\upsilon$ increases.

It is also preferred that the deformable container is arranged within a substantially tubular side pocket adjacent to the venturi, that the container is an at least partly flexible bag which is retrievably arranged in said side pocket and that the venturi and container are arranged in a sleeve which fits within and can be secured to the inner wall of a well conduit within or adjacent to an inflow region of the well.

Optionally the outlet of the container is equipped with a valve which opens the outlet during selected intervals of time. The valve may be actuated by a clock or by a device which sequentially opens and closes the valve in a predetermined pattern such that the pulsed release of tracer material represents a signal which corresponds to a physical parameter, such as pressure, temperature or fluid flow rate and/or composition measured by a sensor which is embedded in or near the venturi.

DESCRIPTION OF PREFERRED EMBODIMENTS

The invention will be described in more detail, by way of example, with reference to the accompanying drawings, in which FIG. 1 is a longitudinal sectional view of a first embodiment of the tracer release system according to the invention;

FIG. 2 is a cross-sectional view of the system of FIG. 1;

FIG. 3 is a longitudinal sectional view of a second embodiment of the tracer release system according to the invention; and FIG. 4 is a cross-sectional view of the system of FIG. 3.

DETAILED DESCRIPTION OF THE DRAWINGS

Referring now to FIGS. 1 and 2 there is shown a continuous tracer injection system that comprises an elongate bag 1 which is filled with a liquid tracer, such as a radioactive or fluorescent on genetically coded composition.

The bag 1 is arranged in a tubular cavity 2 adjacent to the neck portion 3 of a downhole venturi 4 which is mounted within a tubular sleeve 5 which can be retrievably mounted in a well tubular (not shown) in the inflow region of a well (not shown).

The cavity 2 is in fluid communication with a relatively wide portion 9 at the entrance of the venturi 4 via fluid passage 6.

The bag 1 has at its upper end a fluid outlet 7 which is in fluid communication with the neck portion 3 of the venturi 4 via a radial outlet passage 8. In use the fluid stream will flow through the sleeve 5 at the entrance of the venturi 4 at a fluid velocity $\upsilon$ and will accelerate in the neck portion 3 to a higher velocity, which will in accordance with Bernouilli's law, generate a static pressure difference which is proportional to $\frac{1}{2}\rho.\upsilon^2$, wherein $\rho$ is the fluid density and $\upsilon$ is the fluid velocity.

Since the fluid pressure within the bag 1 equals that in the neck portion 3 and the fluid pressure in the cavity 2 below the bag 1 equals that within the wide entrance 9 of the venturi 4 the bottom of the bag 1 will be pushed up by a pressure $p \sim \frac{1}{2}\rho.\upsilon^2$, which initiates compression of the bag and squeezing out of a flux T of tracer material which is proportional to that pressure difference p, and thus to the fluid density $\rho$ and squared velocity $\upsilon$.

Hence, by detecting the amount of tracer T released per unit of time by a detector unit at the earth surface, which may be a Geiger counter if a radioactive tracer is used or a light source and reflection unit of a fluorescent tracer is used information can be gathered about the downhole fluid velocity $\upsilon$ and/or density $\rho$.

Referring now to FIGS. 3 and 4 there is shown a discontinuous tracer injection system which comprises a bag 10 that is filled with a liquid tracer material.

The bag 10 is arranged in a tubular cavity 11 which is parallel to the neck portion 12 of a venturi 13 which is arranged in a sleeve 14 that can be retrievably inserted in a well tubular (not shown) in the inflow region of an oil and/or gas production well (not shown).

The bag 10 has an outlet 15 which intermittently releases tracer material into a tracer injection port 16 that debouches into the neck portion 12 of the venturi 13 via a valve 17.

The valve 17 is equipped with a battery 18 that supplies electrical power to activate the valve 17 and with a steering unit 19 comprising a clock and/or temperature, fluid composition sensor(s) 20 which induces the valve to open and close at irregular time intervals in a pattern that represents signals that reflect the temperature and/or other physical data detected by the sensor(s) 20. The discontinuous opening of the valve 17 causes an intermittent injection of tracer material T into the fluid stream, which injection pattern can be detected by tracer detection unit at the earth surface.

Like in the system of FIG. 1 the pressure p exerted to the bag 10 is proportional to $\frac{1}{2}\rho.\upsilon^2$, so that the amount of tracer released per unit of time provides information about the downhole fluid velocity $\upsilon$ and/or density $\rho$.

Accordingly the tracer release system according to the invention can be used as a hybrid velocity measurement and wireless data transmission system in a well, which can operate during several years until the bag 10 and battery 18 are depleted.

The sleeve 14 may be releasably mounted within an unslotted section of a slotted well liner in the inflow region of an oil and/or gas production well. In such case it is preferred that said unslotted section is equipped with an external expandable sealing ring which seals off the annular space surrounding the unslotted section of the liner to induce the well effluents to flow through the interior of the sleeve 14.

What is claimed is:

1. A method for monitoring the fluid flowrate in a downhole well conduit, the method comprising:

inserting in the well a deformable container comprising tracer material which is in fluid communication with a venturi formed in the well conduit such that in use an amount of tracer material is released through an outlet of the container into the conduit which is related to the static pressure difference between a neck portion of the venturi and a wider portion of the conduit;

detecting the amount of tracer material flowing through the conduit per unit of time at a location downstream of the release system;

measuring the amount of released tracer material flowing through the conduit at a location downstream of the venturi; and determining a fluid velocity and/or density in the conduit in the vicinity of the venturi on the basis of said measurement.

2. The method of claim 1, wherein at least part of the wall of the deformable container as exposed to the static pressure within said wider portion of the conduit and the outlet of the container debouches into the neck portion of the venturi.

3. The method of claim 2, wherein the deformable container is arranged within a cavity in the wall of the conduit adjacent to the venturi.

4. The method of claim 3, wherein the cavity is a substantially tubular side pocket and the deformable container is an at least partly flexible bag which is retrievably arranged inside said side pocket.

5. The method of claim 3, wherein the venturi and deformable container are arranged in a sleeve which fits within and can be secured to the inner wall of the well conduit within or adjacent to an inflow region of the well.

6. The method of claim 1, wherein the well has a plurality of inflow regions and at least one tracer release system is located at or near a downstream end of one or more inflow regions.

7. The method of claim 6, wherein a plurality of tracer release systems comprising deformable containers with tracer material are arranged in the well, which systems are filled with different radioactive, fluorescent or genetically marked tracers.

8. The method of claim 6, wherein the well is provided with a plurality of tracer release systems which are provided with valves dial are actuated by a clock such that the valves are opened at different moments in time.

9. The method of claim 1, wherein the outlet of the container is equipped with a valve which is adapted to open the outlet during one or more selected intervals of time.

10. The method of claim 9, the is actuated by a clock which is adapted to open the valve at a pre-set time and during a predetermined interval of time.

11. The method of claim 9, wherein the valve is actuated to sequentially open and close during selected intervals of time, and the length and pattern of said intervals represents a signal which corresponds to one or more physical parameters such as pressure, temperature and/or density measured by a measuring probe embedded in the tracer release system.

12. The method of claim 5, wherein the sleeve is releasably secured in a section of a well liner which is equipped with an external expandable sealing ring, which ring inhibits well effluents to flow through an annular space surrounding the liner at the location of the sleeve.

* * * * *